US005159975A

United States Patent [19]

Murphy

[11] Patent Number: 5,159,975

[45] Date of Patent: Nov. 3, 1992

[54] UNIT TO ENHANCE HEAT TRANSFER THROUGH HEAT EXCHANGER TUBE

[76] Inventor: Guy R. Murphy, 22W202 Foster Ave., Medinah, Ill. 60157

[21] Appl. No.: 832,318

[22] Filed: Feb. 7, 1992

[51] Int. Cl.[5] ..... F28B 9/08

[52] U.S. Cl. ..... 165/110; 165/182; 165/184; 165/913; 62/290

[58] Field of Search ..... 165/110, 111, 133, 182, 165/184, 183, 913; 62/287, 288, 289, 290

[56] References Cited

U.S. PATENT DOCUMENTS

| | | | |
|---|---|---|---|
| 496,757 | 5/1893 | Theisen | 165/95 |
| 2,983,115 | 5/1961 | Caswell | 165/110 X |
| 3,358,750 | 12/1967 | Thomas | 165/183 X |
| 3,508,608 | 4/1970 | Roe | 165/111 |
| 4,253,519 | 3/1981 | Kun et al. | 165/110 |

FOREIGN PATENT DOCUMENTS

| | | | |
|---|---|---|---|
| 984156 | 2/1965 | United Kingdom | 165/184 |

*Primary Examiner*—Allen J. Flanigan
*Attorney, Agent, or Firm*—John L. Schmitt

[57] ABSTRACT

A unit to enhance heat transferring through a tube in a condenser-type heat exchanger comprises a series of elements. The elements engage a surface of the tube in contact with a high temperature condensable medium flowing through the exchanger. The elements are spaced apart, positioned parallel and have ring-like configurations. The elements are positioned on an angle so that when the unit is secured to a vertical tube, each element has a low point. These low points align and connect with a vertical riser. In use the tube is one of a set forming a tube bundle fitted into a vessel of the heat exchanger. As heat transfers from the high temperature medium, for example steam flowing through the vessel to a lower temperature medium, for example cooling water flowing through the tubes, the steam condenses on the tube. The condensed steam builds into a thickening film that then flows down the tube. This downward condensate flow is diverted by the elements of the unit and runs to the low point of each element. At the low points the condensate then drains down the riser to collect in a bottom of the vessel for discharge.

8 Claims, 3 Drawing Sheets

UNIT TO ENHANCE HEAT TRANSFER THROUGH HEAT EXCHANGER TUBE

BACKGROUND OF THE INVENTION

1. Field of the Invention

This invention relates to means for improving a rate of heat transfer from a high temperature condensable medium and a lower temperature medium flowing through a heat exchanger and more particularly to a unit that may engage an upright positioned tube in a high-capacity heat exchanger to reduce a thickness of condensate film that forms on and then flows down the tube as the condensable medium cools and condenses on the tube.

2. Prior Art

Heat transfer has been studied extensively and is mathematically defined in many learned writings on this subject. Devices for transferring heat come in many forms. For example, in many domestic water heaters high temperature products of combustion from burning natural gas are used to heat cooler tap water. In other devices the high temperature medium may be a condensable vapor such as steam or Freon.

Additionally, such heat exchanging devices often include means to increase the rate of heat transfer. In U.S. Pat. No. 3,837,396 a series of fins are shown attached to a set of tubes. The fins increase the effective area of the tube surface through which heat may pass and therefore the rate at which heat energy may transfer therethrough. Also the tubes may include inner structure for diverting a flow of condensate forming on an inner surface of the tube. This inner structure may have a tree-like shape or be in the form of a series of spaced apart cups.

U.S. Pat. No. 496,757 discloses earlier apparatus for condensable vapor use. In this case a tube of the apparatus includes a set of three, spaced apart wires formed into a downwardly sloped helix that fits about the tube. These wires provide like-shaped, continuous paths for a downward flow of condensate forming on the tube.

U.S. Pat. No. 2,983,115 shows another early example of heat transfer apparatus particularly adapted for a condensable vapor. This apparatus comprises a coil having a set of spaced apart, horizontal tube sections. Each tube section has extended surface elements in the form of a continuous fin spirally formed thereabout. Respective notches in a bottom of the elements define a channel shaped area for a trough. During use condensate forms on each tube and attached elements. This condensate drains down the elements to collect in the respective troughs and then flow away from the coils.

U.S. Pat. No. 3,358,750 sets out still further means for improved transferring of heat. In this case an upright condenser tube has a set of vertically affixed bar elements. During use condensate forming on the tube is drawn by capillary action to fillet areas formed by the tube and a base of each element. Condensate collecting in these fillet areas drains downward.

Lastly, U.S. Pat. No. 4,715,433 discloses a more recent exchanger particularly adapted for cryogenic applications. This exchanger has a series of alternately stacked condensing units and reboiler units. Each condensing unit comprises a pair of spaced apart, vertically positioned plates. Between these plates and attached to an inner side of each is a set of vertically spaced apart, hollow bars positioned on an angle. In a top surface of each bar is a series of openings to receive a downward flow of condensate forming on the plate inner side above that bar. Diversion of the condensate flow by the bars inhibits any excessive condensate build-up on the plates.

SUMMARY OF THE INVENTION

A unit of this invention comprises a series of ring-like shaped wire elements. The elements are spaced apart, positioned parallel to each other, and on an angle. When secured to a vertically positioned tube in a heat exchanger, each element has a low point. Theses element low points align so that a wire-like vertical riser may be attached thereto to form the unit into an integral structure. For use the unit fits snugly about each tube of a tube bundle of the heat exchanger. As positioned, the tube and the elements define a set of leak-resistant, downwardly sloped channels. A lower end of the riser extends to a bottom area of the exchanger.

Exchangers are used widely in power plants, refineries, and chemical plants. In a power plant a condenser-type heat exchanger receives high temperature, high pressure steam vapor discharging from a turbine. The steam is cooled and condenses on contact with the exchanger tubes through which cooling water is circulated.

Similar units also may be placed inside tubes forming part of a condenser of a high-capacity air conditioning system. In this case the high temperature condensable vapor typically is compressed Freon which flows through the condenser tubes while an outer surface of the tubes is subjected to a temperature lowering stream of air.

As a transfer of heat occurs in either of the above noted condensers, the temperature of the vapor next to the tube surface decreases to a point where that vapor condenses on the tube to form a layer of condensate. As the condensate collects and then drains down the tube, the condensate flow is diverted by the unit elements, runs down the channels to the element low points, and then drains down the riser to collect for discharge from the exchanger..

The unit of this invention that enhances the rate of heat transferring through a tube in a high-capacity, condenser-type heat exchanger provides several advantages over other like means known or in use.

A first advantage is that the unit and tube to which the unit attaches are separate items. Therefore, the unit can be made from a material different from that of the tube and in sizes to fit about or in any conventional heat exchanger tube having a 0.75 in. or greater diameter.

To appreciate the advantage of being able to make the tube and unit from different materials, it should be understood that in processing chemical agents, for example, it is not uncommon for the agent to be highly corrosive. The agent is heated by pumping it through the tubes of a heat exchanger while slightly corrosive condensable steam flows through the exchanger vessel. While the tubes must be made of high cost, hard-to-form corrosion resistant material, the unit may be more readily formed of inexpensive carbon steel which then may be plated or plastic coated to resist rusting from its contact with steam.

A further benefit of the tube and unit being separate items is that tube or unit may be separately replaced because of respective damage to or wear of either. The position of the unit on the tube is merely secured by friction allowing its ready removal.

A second advantage of this inventive unit is that it may be used with tubes in a heat exchanging condenser having tubes of its tube bundle spaced in a standard array. Because the elements and riser of the unit are wire-like and thus quite thin, the effective diameter of each tube only is increased slightly when a unit is secured to the outer side of the tube.

Note that if fins or like projections were added to each tube in a tube bundle, the tubes then must be spaced further apart. Such wider spacing then would require a larger and thus more expensive heat exchanger vessel to maintain the capacity of the exchanger. A larger exchanger vessel correspondingly requires increased pipe sizes and pumping capacity. Larger pumps and piping sizes increase system costs substantially. Where more corrosion resistant materials are required, increased component sizes could be cost prohibitive.

A still further advantage of this unit is that only a small surface area of a tube is covered by the elements. Since the area of contact between the unit elements and the tube is minimal and the fit between each element and the tube may be less than perfect, the rate at which heat may conduct between the elements and tube is low. Heat transfer is enhanced by maximizing the exposed area of tube.

A last and most important advantage of this unit is that the rate of heat transferring through the tube is increased by the unit inhibiting an excessive condensate film build-up on the tube. On a plain tube this build-up occurs as vapor condenses on and then runs down the tube. With a unit fitted to the tube, the condensate build-up remains thin. The multiple elements of the unit intercept the downward condensate flow which runs down the element channels to the element low points and then drains down the riser. Reducing the thickness of this condensate flow allows heat to transfer at an increased rate. Thus, the size of the condenser, connecting piping, and other system components may be reduced to effect a cost saving greater than the cost of the units.

DESCRIPTION OF THE PREFERRED EMBODIMENTS

Figure 1:
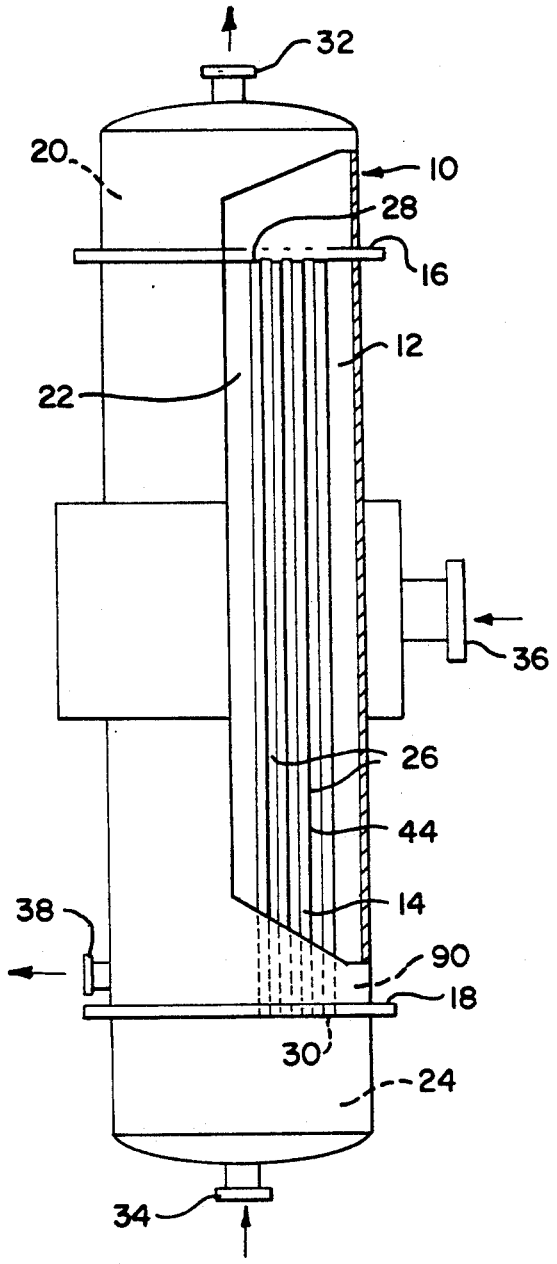
FIG. 1 is a schematic of a typical high-capacity, condenser-type heat exchanger having a portion of a vessel of the exchanger cutaway to show a corresponding interior portion of the exchanger.

A high capacity, condenser-type heat exchanger is shown generally in FIG. 1 and designated 10. The exchanger 10, like most all high-capacity exchangers, comprises a cylindrical containment vessel 12 which holds a tube bundle 14. The tube bundle 14 has a top and a bottom end plate 16, 18 that divide the vessel 12 into a top discharge chamber 20, a middle transfer chamber 22, and a bottom inlet chamber 24.

The tube bundle 14 further includes a series of vertically positioned tubes 26. Respective open upper and lower ends 28, 30 of these tubes 26 are secured respectively in the top and bottom end plates 16, 18. The tube upper ends 28 communicate with the discharge chamber 20 which in turn connects with a top discharge fitting 32. In a similar manner the lower ends 30 of the tubes 26 communicate with the inlet chamber 24 which in turns connects with a bottom inlet fitting 34. The vessel transfer chamber 22 in a similar manner has an upper intake fitting 36 and a lower outlet fitting 38.

Figure 2:
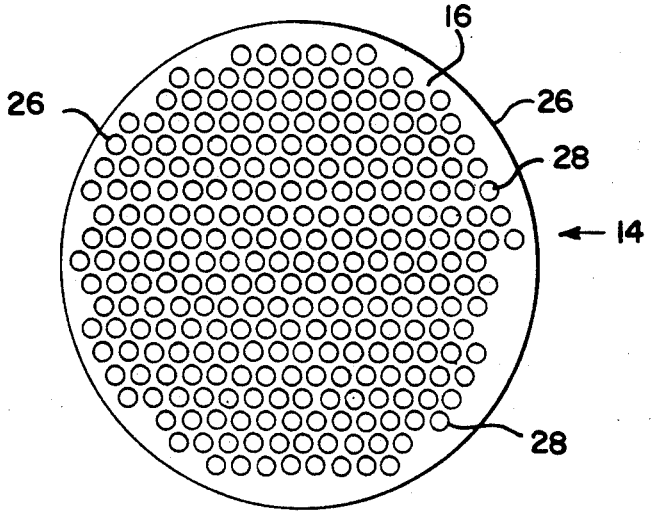
FIG. 2 is a plan view of an upper end of a tube bundle of the exchanger of FIG. 1.

Positioning of the tubes 26 in the top plate 16 is shown in FIG. 2. This positioning conforms with industry standards for heat exchangers having cylindrical shaped containment vessels. This cylindrical configuration is most cost effective and approved for high pressure operation. Where tubes in a bundle have a 2.0 in. diameter, a minimum 0.50 in. space is provided therebetween.

Figure 3:
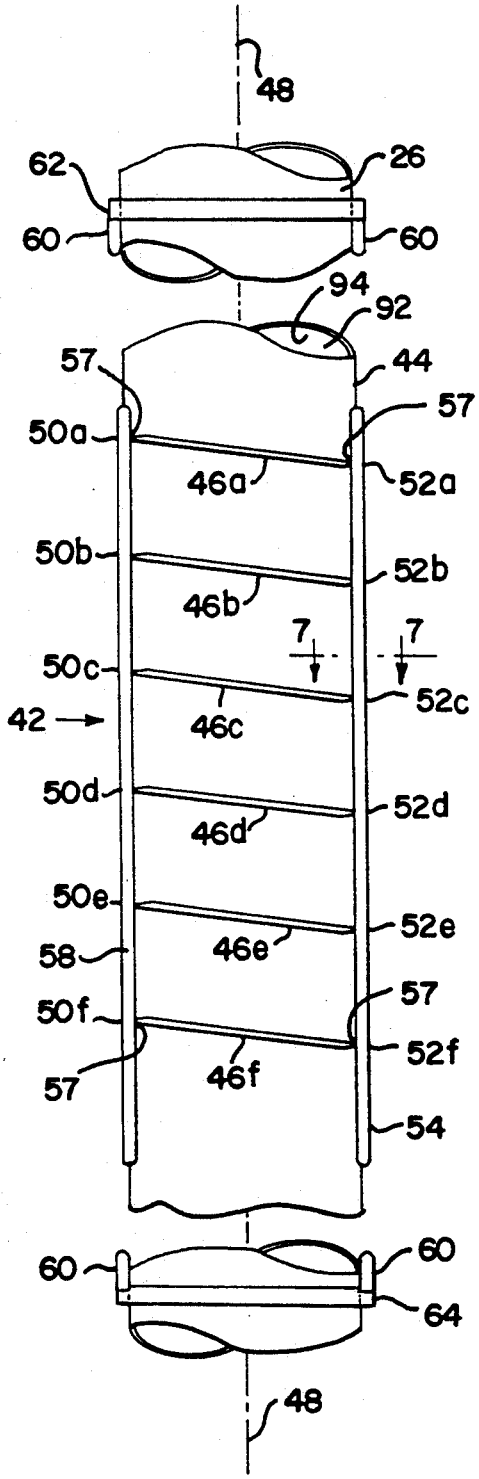
FIG. 3 is a side elevation view of portions of one tube of the tube bundle to which a first embodiment of a unit of this invention has been fitted.
Figure 4:
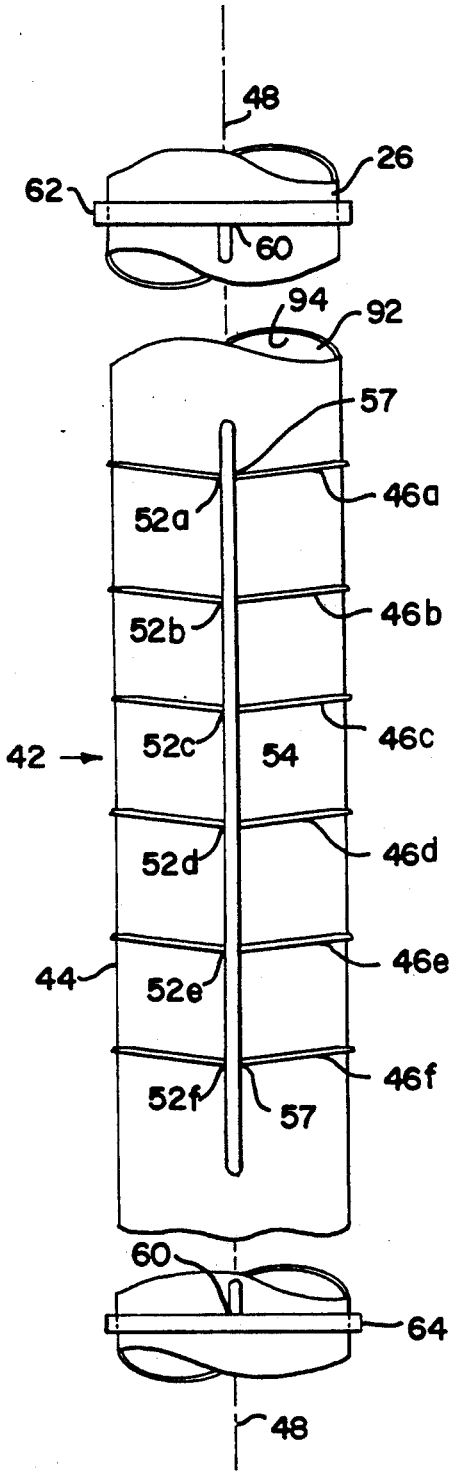
FIG. 4 is front elevation view of the tube and unit of FIG. 3.

A first embodiment of a unit to enhance heat transfer through a tube in a condenser-type heat exchanger is set out in FIGS. 3 and 4 and designated 42. The unit 42 comprises a series of vertically spaced apart elements 46 which are more specifically identified as **46*a*–46*f*. These elements 46*a*–46*f* are positioned parallel and on an angle with respect to a vertical axis 48 of the tube 26. The elements 46*a*–46*f* are formed from wire-like material to have an elliptical, ring-like configuration that fits fully about an outer surface 44 of the tube 26. If the tube diameter were 2.0 in., then a thickness of the elements 46*a*–46*f* typically would be slightly less than 0.0625 in. As positioned, the elements 46*a*–46*f* have respective high points 50*a*–50*f* and respective low points 52*a*–52*f***.

Note that elements of a unit need not have a continuous form and as such be fully circumferential. Elements could have spaced apart ends, for example; additionally, elements of a unit may have multiple low points and/or high points whether circumferential or finite in length with ends.

Figure 7:
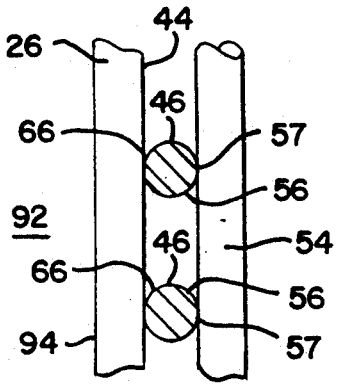
FIG. 7 is a detailed, cross sectional view showing a portion of an inventive unit engaging an outer surface a tube of an exchanger.

The unit 42 further includes a vertically positioned, conduit riser 54 also made of a wire-like material. The riser 54 joins an outer side 56 of each element **46*a*–46*f* at its respective low point 52*a*–52*f* to form a set of respective ductile connections 57 therebetween and shown typically in FIG. 7. These connections 57 form the unit 42** into an integral, self-supporting structure.

For additional strength the unit 42 may include a support riser 58 joined to the elements **46*a*–46*f* at their respective high points 50*a*–50*f* by another like set of ductile connections 57. Ends 60 of the risers 54, 58 also may extend beyond the uppermost element 46*a* and lowermost element 46*f* and there be secured respectively by a top and bottom support sleeve 62, 64 if still further rigidity is needed. It should be understood that regardless of the use of the sleeves 62, 64 that in practice the elements 46 of the unit 42 extend between the top and bottom end plates 16, 18 of the tube bundle 14 to engage substantially an entire length of the outer surface 44 of the tube 26**.

The wire material for the risers 54, 58 has a thickness like that of the elements **46*a*–46*f*. Therefore, the entire unit 42 extends outward from the tube surface 44 a distance less than 0.125 in. As a result the unit 42 only increases an overall diameter of a 2.0 in. tube to a diameter somewhat less than 2.25 in. assuming the unit 42 has two risers 54, 58**.

The ductile connections 57 between the elements 46*a*–46*f* and the riser 54 or both risers 54, 58 allow the elements 46*a*–46*f* and risers 54, 58 to flex under an applied force to a more perpendicular position. When so located, the effective diameter of each element 46*a*–46*f* is increased to allow the unit 42 to be placed more easily about or removed from the tube 26. Once in place the applied force is removed so that the flexed connections 57 return the elements 46*a*–46*f* and risers 54, 58 to their originally angled relationship. There the elements 46*a*–46*f* compressively engage the tube 26 and form snug, leak-resistant fits that define a set of downwardly sloped, V-like shaped channels 66 shown typically in FIG. 7.

Figure 5:
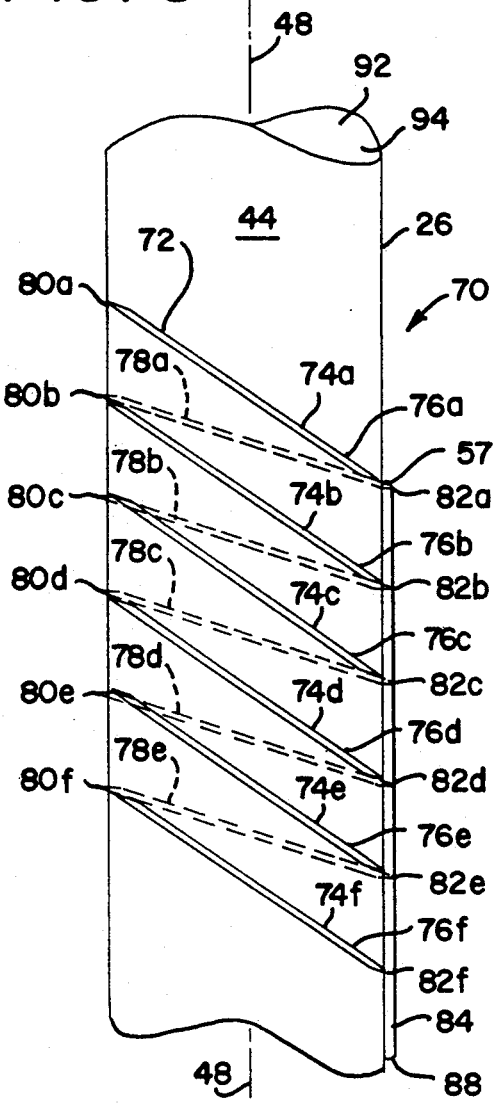
FIG. 5 is a side elevation view of another embodiment of the inventive unit.
Figure 6:
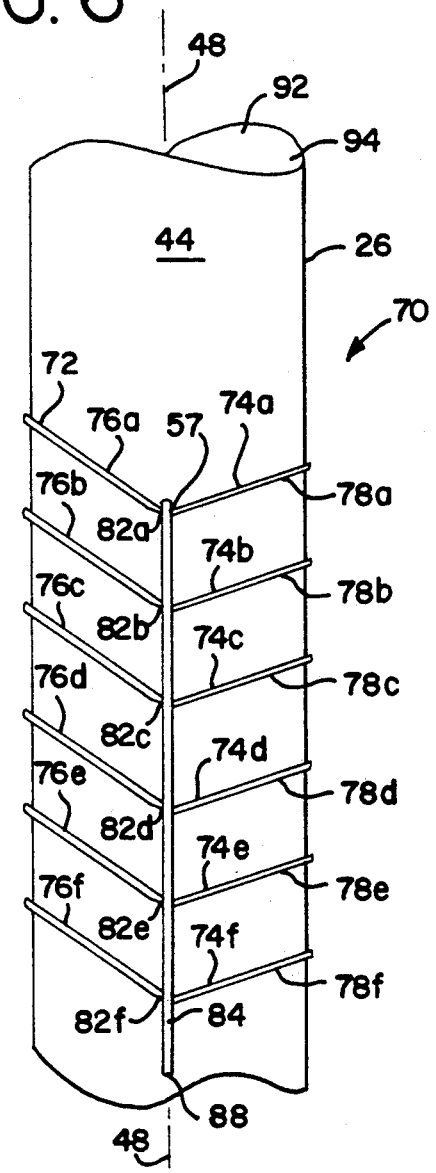
FIG. 6 is a front elevation view of the unit of FIG. 5.

A second embodiment of a unit to enhance a rate of heat transfer through a tube in a condenser-type heat exchanger is shown in FIGS. 5 and 6 and designated 70. The unit 70 has a continuous body 72 having a modified helix shape. However, in spite of this different shape the unit 70 is like the unit 42 in most all other respects. Therefore, like reference numbers are used to identify like structure.

The form of the unit body 72 defines a series of 360 deg. convolute elements 74*a*–74*f*. These elements 74*a*–74*f* respectively comprises first segments 76*a*–76*f* and second segments 78*a*–78*f* with the first segments 76*a*–76*f* located on a greater downward slope than the slope of the second segments 78*a*–78*f*. Upper ends of the first segments 76*a*–76*f* define a set of element high points 80*a*–80*f*; respective joinders of the first and second segments 74*a*–74*f*, 76*a*–76*f* define a set of element low points 82*a*–82*f*. Note that a high point 80 also is defined by a joinder of a lower end of a second segment with an upper end of a first segment of a next lower element, for example the high point 80*d* is at the joinder of the upper end of second segment 78*c* and the upper end of first segment 76*d*.

The unit 70 also includes a vertically positioned, conduit riser 84. This riser 84 is joined to the outer side 56 of the elements 74*a*–74*f* at each element low point 82*a*–82*f* by a like set of ductile connections 57 discussed above. The connections 57 of the unit 70 also allow flexing of the elements 74*a*–74*f* so that the elements 74*a*–74*f* snugly engage the tube 26 in a leak resistant manner and form a like set of channels 66.

A lower end 88 of the riser 84 extends below the lowermost element 74*f* and into a bottom area 90 of the exchanger transfer chamber 22. While not shown, the unit 70 may include a support riser attached to the element outer side 56 at each high point 80*a*–80*f*. Further, the unit 70 may have a set of upper and lower support sleeves (not shown); the sleeves for the unit 70, like the sleeves 62, 64 for the unit 42, are positioned about the tube 26 for connection of the conduit riser 84 and a support riser.

With the heat exchanger 10 operatively connected to a discharge of a steam turbine (not shown) in a power plant system, the intake fitting 36 of the chamber 22 is joined to a discharge of the turbine. Steam from the turbine flows into the transfer chamber 22 to surround the tubes 26 of the tube bundle 14.

Concurrently, a supply of cooling water is connected to the bottom inlet fitting 34 of the bottom inlet chamber 24. Cooling water flows through the fitting 34 and the chamber 24, into the tube lower ends 30, and then upward through an inner space 92 of each tube 26.

The entering steam, having a temperature of about 900 deg. F., is designated the high temperature medium; the cooling water having a temperature of about 100 deg. F. is designated the lower temperature medium. Because of this temperature differential heat energy transfers from the steam to the cooling water so that the steam cools to a temperature of about 212 deg. F. At this lower temperature the steam condenses to form a layer of condensate on the outer surface 44 of the tubes 26.

This condensate layer increases in thickness to a point where gravity causes an outer portion of the layer to flow down the tube 26. As is well known, this flow has an upwardly extending wedge-like shape as condensate forming above flows down to combine with condensate forming therebelow.

The flow is continuous and is intercepted by the elements of the unit, for example elements 46*a*–46*f* of the units 42 fitted respectively to each tube 26 of the tube bundle 14. The intercepted condensate flows down the channels 66 to the respective low points 52*a*–52*f* of the elements 46*a*–46*f*. Flow in the channels 66 is induced by gravity and by capillary interaction from confinement of the condensate in the channels 66. The snug fit between the elements 46*a*–46*f* and the tube surface 44 inhibits any flow therebetween while any condensate spillover is inhibited by the capillary effect on the flow.

Note that the volume of condensate being formed may be calculated and therefore known. As a consequence the vertical spacing and the slope of the elements 46*a*–46*f* is selected so that the volume of condensate flow at each element low point 52*a*–52*f* does not exceed an amount that would produce a spillover. The condensate runs smoothly from the elements 46*a*–46*f* onto the riser 54 and then drains to the transfer chamber bottom area 90 for discharge through the lower outlet fitting 38.

Figure 8:
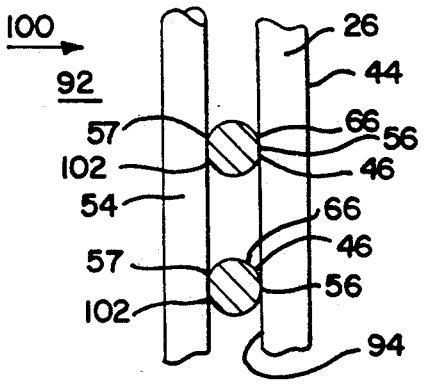
FIG. 8 is a detailed, cross sectional view showing a portion of an inventive unit modified to engage an inner surface of a tube of an exchanger.

As noted briefly above, a refrigeration system typically is configured so that its condensable medium, for example Freon, flows through the inner space 92 of the tubes 26 of a condenser to interface with an inner surface 94 of each tube 26. In this application, a further unit 100 is located in the tube inner space 92. The unit 100 may have elements like the elements 46*a*–46*f* of the unit 42 or the elements 74*a*–74*f* of the unit 70. A portion of the unit 100 is shown in FIG. 8 and has a set of elements 46*a*–46*f* like the unit 42. The only further difference of the unit 100 is that its riser 54 is joined to an inner side 102 of each elements 46*a*–46*f* with the element outer side 56 then in snug, leak resistant contact with the inner surface 94 of the tube 26 to define a further set of V-like shaped channels 66. In this case the ductile connections 57 between the riser 54 and the elements 46*a*–46*f* of the unit 100 allow the elements 46*a*–46*f* to be flexed into a position of increased angularity to facilitate insertion of the unit 100 into the tube inner space 92.

The rate at which steam or other vapor cools and then condenses is dependent on several factors. One factor is the conductivity of the material through which the heat energy passes during its transfer. Conductivity of most materials is known and expressed as a "k-value" or coefficient of conductivity, i.e., Btu/(hr.)(sq.ft.)(deg.F/ft.). A low k-value indicates a high resistance to the transfer of heat while a high k-value means a low resistance. Most metals have high k-values, for example mild steel has a k-value of about 33. Liquids typically have lower k-values, for example water has a k-value of about 0.394 at 212 deg. F. Therefore, under like conditions the rate at which heat transfers through a thickness of steel is about 84 times greater than the rate at which heat transfers through a like thickness of a layer of water.

The effect of a unit such as the unit 42 or unit 70 fitted to a tube 26 can be pronounced. In one test of an earlier unit embodiment, about 50 percent more steam condensed on a tube fitted with that unit than on a plain tube operating under identical conditions.

There are several reasons for the increased rate of heat transfer and thus the volume of resulting condensate. First, elements of that unit were effective in minimizing the thickness of the film condensate layer on the tube. Since the thickness of the condensate layer is inversely proportional to the rate at which energy may transfer and the condensate, being water, has a low coefficient of conductivity, thinning this condensate layer allows the heat to pass at an increased rate.

A second reason for the higher rate of heat transfer is that the elements of the unit cover only a minimal area of the tube. Note that k-values include an area unit. This means that heat will transfer at a higher rate through a larger area. Elements of a unit are ineffective for such transfer because the line contact between the tube and the elements creates almost no area though which any transfer may occur. Additionally, the line of contact as a practical matter may not be continuous. Therefore, heat best transfers through the surface of the tube which is only minimally covered by the elements of the unit.

While embodiments, uses and advantages of this invention have been shown and discussed, it should be understood that this invention is limited only by the scope of the claims. Those skilled in the art will appreciate that various modifications or changes may be made without departing from the scope and spirit of the invention, and these modifications and changes may result in further uses and advantages.

What I claim is:

1. A unit particularly adapted to increase the rate of heat transfer through a vertically positioned tube in a condenser-type heat exchanger, said unit comprising:

a series of spaced apart, arcuate shaped, wire-like elements, said elements positioned substantially parallel and on an angle with respect to a vertical axis of said tube to form a set of element low points, and a conduit riser joined to said set of element low points, wherein during use said elements of said unit snugly engage said tube to form a leak resistant fit therewith, and said unit increases said rate of heat transfer from a high temperature medium condensing on and then flowing down said tube by said unit reducing the thickness of said flow while said elements cover only a minimal area of said tube.

2. A unit as defined by claim 1 and further characterized by, said elements of said unit having elliptical, ring-like configurations.

3. A unit as defined by claim 1 and further characterized by, said elements formed into a continuous body having a modified helical-like configuration, said low points of said elements defined respectively at a joinder of a first and a second segment of said element, and said first segment positioned on an angle greater than an angular position of said second segment.

4. A unit as defined by claim 1 and further characterized by said unit including, a support riser attached to said elements on a side opposite said conduit riser, and a top and bottom support sleeve prepared to fit on said tube with ends of said risers respectively secured to said sleeves, wherein said unit has an integral, rigid structure that may extend an entire length of said tube and be readily fitted to or removed therefrom.

5. A unit as defined by claim 1 and further characterized by, said joinders of said elements to said conduit riser forming a set of ductile connections allowing flexing of said elements with respect to said riser to facilitate positioning of said elements on said tube with said elements then forming said snug, leak-resistant fit with said tube upon return of said elements to an unflexed condition.

6. A unit as defined by claim 1 and further characterized by, said fit between said elements and said tube defining a set of V-like shaped channels for said condensate flow to run to said element low points, wherein confinement of said condensate in said channels produces a capillary effect that induces said flow to said low points and inhibits said flow from spilling from said channels.

7. A unit to increase a rate of a transfer of heat through a set of standard spaced tubes in a tube bundle of a vertically positioned condenser-type heat exchanger, said unit comprising:

a set of thin, wire-like, elliptical-like shaped elements having one side engaging said tube in a leak-resistant manner that creates a minimal area of contact between said elements and said tube, said elements positioned parallel and on an angle with respect to a vertical axis of said tube to form a set of element low points, a thin, wire-like riser attached to said elements at said low points, and an outward extension of said elements and said attached riser from said tube being less than one half a distance between said tube and adjacent tubes of said bundle, wherein during use a high temperature condensable medium flows into said exchanger to contact said tube, a coolant enters said exchanger to flow inside said tubes, heat energy flows from said high temperature medium to said coolant so that said medium condenses on said tubes and forms condensate that flows down said tubes, said elements of said units intercepting said condensate flow and directing such to said element low points to drain down said risers, and said units increasing said rate of heat transferring through said tubes by reducing a thickness of said condensate flow.

8. A unit to increase a transfer of heat through a set of standard spaced tubes in a tube bundle in a vertically positioned heat exchanger, said unit comprising:

a set of convolute elements formed from a continuous thin, wire-like body having a modified helical-like shape, said elements engaging said tube in a leak-resistant manner that creates a minimal area of contact between said elements and said tube, said elements defined respectively by a first and a second segment with said first segment positioned on a slope greater than a slope of said second segment to form a set of substantially aligned element low points at a joinder of said respective first and second segments, a thin, wire-like riser attached to said elements at said low points, and an outward extension of said elements and attached riser from said tube being less than one half a distance between said tube and adjacent tubes in said bundle, wherein during use a high temperature condensable medium flows into said exchange to contact said tubes, a coolant enters said exchanger to flow inside said tubes, heat energy flows from said high temperature medium to said coolant so that said medium condenses on said tubes to form condensate that flows down said tubes, said elements of said units intercept said flow and direct such to said element low points to drain down said risers, and said units increase said rate of heat transferring through said tubes by reducing a thickness of said condensate flow.

* * * * *